United States Patent [19]

Winton

[11] 4,139,102

[45] Feb. 13, 1979

[54] CLOTHES HANGER RETENTION BAR

[76] Inventor: Mary J. Winton, P.O. Box 889, Placerville, Calif. 95667

[21] Appl. No.: 865,121

[22] Filed: Dec. 28, 1977

[51] Int. Cl.[2] ..... E05B 73/00; A47H 13/00

[52] U.S. Cl. ..... 211/124; 24/248 B; 211/7; 248/231

[58] Field of Search ..... 211/123, 124, 7, 8; 248/251, 231, 74 B, 74 PB; 24/243 K, 248 B; 292/47

[56] References Cited

U.S. PATENT DOCUMENTS

| | | | |
|---|---|---|---|
| 234,799 | 11/1880 | Neely | 24/248 B |
| 1,883,041 | 10/1932 | Somers | 24/248 B |
| 1,975,543 | 10/1934 | Giessler | 211/7 X |
| 2,595,702 | 5/1952 | Prevost | 248/231 X |
| 3,472,385 | 10/1969 | Shapiro et al. | 211/7 |
| 3,659,721 | 5/1972 | Parillo | 211/7 |
| 3,735,875 | 5/1973 | Parillo | 211/7 |

*Primary Examiner*—Roy D. Frazier
*Assistant Examiner*—Terrell P. Lewis
*Attorney, Agent, or Firm*—Blair, Brown & Kreten

[57] ABSTRACT

Disclosed herein is a clamping device which is caused to override a conventional clothes rod in which hangers are caused to overlie. The device includes a clamping means to retain and be constrained on the conventional clothing pole, a pivoting means and an overlying U-shaped clamp which extends over the entire length of the clothes pole so that the hanger is caused to lie inbetween the pole and the U-shaped clamp to retard distortion of the clothing hanger hook during sustained vibrations such as in a camper unit.

2 Claims, 3 Drawing Figures

FIG.1
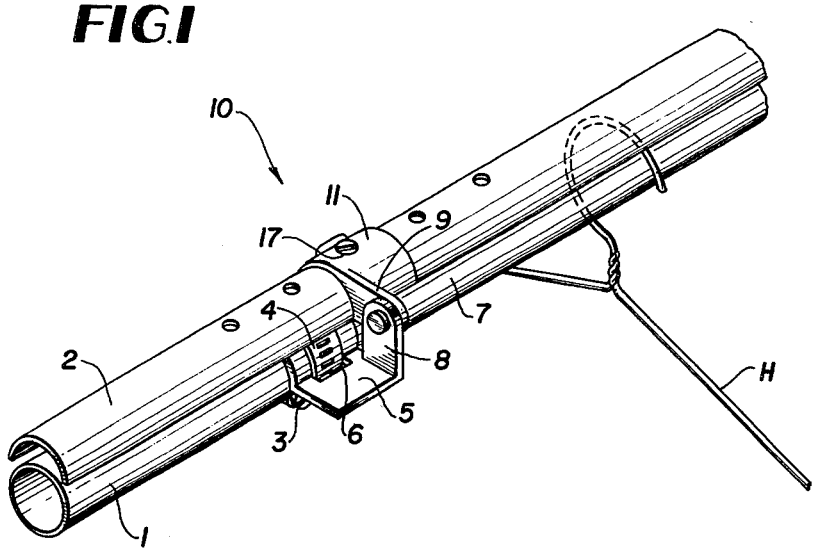
FIG.2
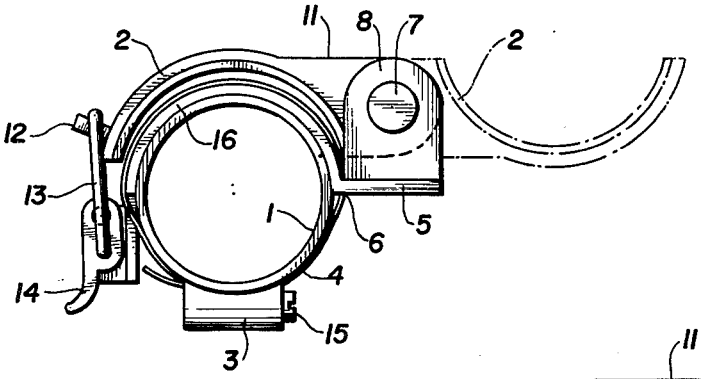
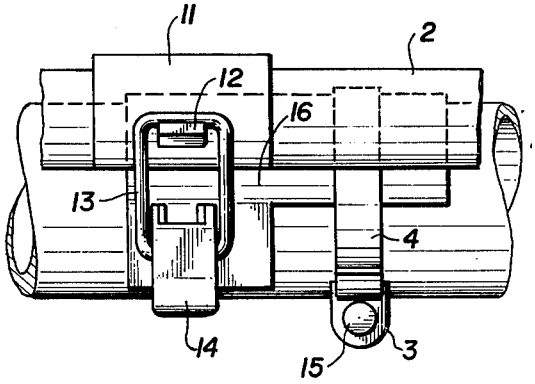
FIG.3

CLOTHES HANGER RETENTION BAR

BACKGROUND OF THE INVENTION

Field of the Invention

This invention relates generally to a clamping device used in association with coat hangers and clothes poles to constrain hangers bearing clothes from removal from the clothes pole. It is well known that during transit such as in a camper or in a foldup type suitcase for hanging clothing the continual motion causes the hangers to deform and straighten out thereby causing the hangers to fall off the clothes pole and frequently results in the clothing draped thereon to become wrinkled and/or soiled.

Devices of which applicant is aware of include U.S. Pat. Nos. 1,990,128, 2,921,728 and 3,875,619. Each of the above references discloses devices for holding hooks on a rod, or holding garments on a garment hanger, but none disclose the specific concept in structure described hereinbelow namely the clamping bracket and its associated structure.

SUMMARY AND OBJECTS OF THE INVENTION

Accordingly an object of this invention is to provide a clothes hanger retention bar which retards hanger deformation.

Another object of this invention contemplates providing a clothes hanger retention bar which is easily adaptable to existing clothes poles.

A further object of this invention contemplates providing a clothes hanger retention bar which is capable of withstanding sustained vibration in a camper or traveling environment without wrinkling or soiling of the garments disposed on the clothing pole.

These and other objects will be made manifest when considering the following detailed specification and drawings.

BRIEF DESCRIPTION OF THE DRAWINGS

FIG. 1 is a perspective view of the apparatus according to the invention;

FIG. 2 is an end view; and

FIG. 3 is a side plan view of the apparatus according to the invention.

DESCRIPTION OF THE PREFERRED EMBODIMENT

Referring to the drawings now wherein like reference numerals refer to like parts throughout the several drawings, reference numeral 10 is generally directed to clothes hanger retention bar according to the present invention.

This retention bar comprises a conventional clothing pole 1 upon which is fastened a bracket structure by means of a hose clamp having a support bracket 3 with a screw 15 disposed within this bracket and an overlying band 4 having slits disposed thereon to coact against the threads of screw 15 to provide loosening and tightening effect.

This clamp is looped through a bracket 5 having a hole therein 6 and overlies a portion of the bracket 16 which can generally be regarded as semi-cylindrical. FIG. 2 generally shows the bracket 5 as having a horizontal section 5 which terminates in a vertical link 8 having an hole through which hinge member 7 is disposed.

Hinge member 7 is connected to an additional U-shaped bracket and thus can be pivotally caused to override bar 1 has is best seen in FIG. 2. The U-shaped bracket generally denoted by reference numerals 11 and 2 are connected to the hinge member 7 by ear 9 and it is to be understood that although only one bracket assembly is depicted in FIG. 1. A mirror image of this apparatus is disposed at the other extremity of the clothes pole 1 so that hinge 7 is supported in two places and the brackets are preferably two in number.

The U-shaped bracket can further be defined by noting that reference numeral 11 is directed to a portion of the bracket having means for screws 17 disposed thereon. This allows the lower portion of this U-shaped bracket 2 to be laterally adjusted along the axis of the clothes pole 1.

FIGS. 2 and 3 show the locking member which constrains the U-shaped bracket 2 against the clothes pole 1 and it is to be noted that the structural details can be summarized as follows. U-shaped bracket 2 terminates at its end remote from the hinge 7 in an upstanding tab member 12 and another portion of the bracket 16 has disposed thereon a pivotable retention lever 14, so that tab 12 and lever 14 can be selectively engaged by allowing link 13 to overlie tab member 12 and rotating lever 14 downwardly as shown in FIGS. 2 and 3 to tightly engage one against the other. In this mode, and when the hanger H is allowed to be nested between member 1 and 2 the hanger loop or upper portion is unlikely to deform based on the reaction of clothes depending therefrom and the inherent inertia so that when a camper vehicle or similar traveling conveyance generates forces on the hanger the tendency of the hanger to straighten out in the top loop portion is prohibited by this clamping arrangement.

Having thus described the invention it will be apparent that numerous structural modifications are contemplated as being a part of this invention as detailed hereinabove and as set forth in the claims.

What is claimed is:

1. A clothes hanger retention bar comprising a clothing pole, bracket means attached to said clothing pole, clamping means attached to said bracket means, and lock means disposed on said bracket means and said clamping means whereby said bracket means and said clamping means can be locked together; said bracket means includes a semi-cylindrical plate member fastened to said clothing pole by a hose clamp, and wherein said bracket means has a horizontal portion extending outwardly from said semi-cylindrical plate which terminates in a vertically extending link; and wherein said clamping means includes a second semi-cylindrical plate connected to said bracket means by a hinge means through said vertical link; said clamping means has an upper and lower portion, and wherein said lower portion is axially adjustable relative to said upper portion.

2. The apparatus of claim 1 wherein said upper portion has an outwardly extending tab, and said lock means includes a link which is pivotally connected to a lever disposed on said bracket means and is caused to overlie said tab to provide said locking.

* * * * *